US008833876B2

(12) United States Patent
Lee

(10) Patent No.: US 8,833,876 B2
(45) Date of Patent: Sep. 16, 2014

(54) HIDDEN WALL STORAGE SYSTEM

(76) Inventor: Earl Lee, Acworth, GA (US)

( * ) Notice: Subject to any disclaimer, the term of this patent is extended or adjusted under 35 U.S.C. 154(b) by 0 days.

(21) Appl. No.: 13/288,921

(22) Filed: Nov. 3, 2011

(65) Prior Publication Data

US 2013/0113350 A1 May 9, 2013

(51) Int. Cl.

| | |
|---|---|
| ***A47B 67/02*** | (2006.01) |
| ***A47G 29/10*** | (2006.01) |
| ***A47G 1/12*** | (2006.01) |
| ***A47G 25/06*** | (2006.01) |

(52) U.S. Cl.

CPC *A47G 1/12* (2013.01); *A47G 29/10* (2013.01); *A47G 25/06* (2013.01)

USPC ..... 312/242; 312/227

(58) Field of Classification Search

CPC ..... A47B 67/00; A47B 67/02

USPC ..... 312/242, 224, 225, 226, 227, 326, 329

See application file for complete search history.

(56) References Cited

U.S. PATENT DOCUMENTS

| | | | | |
|---|---|---|---|---|
| 1,707,013 | A * | 3/1929 | Hoegger | 312/242 |
| 4,083,314 | A | 4/1978 | Garvin | |
| 4,155,608 | A * | 5/1979 | Orlewicz | 312/204 |
| 4,244,303 | A * | 1/1981 | Kurasik | 109/23 |
| 4,304,447 | A * | 12/1981 | Ellwood et al. | 312/204 |
| 4,681,380 | A * | 7/1987 | Carlin | 312/242 |
| 4,821,652 | A | 4/1989 | Hoffman | |
| 4,995,681 | A * | 2/1991 | Parnell | 312/242 |
| 5,066,079 | A | 11/1991 | Lawrence | |
| 5,141,300 | A * | 8/1992 | Ciesla | 312/204 |
| 5,368,378 | A * | 11/1994 | Curtis | 312/204 |
| 5,586,934 | A | 12/1996 | Dombrowski et al. | |
| 5,954,411 | A * | 9/1999 | Katz | 312/242 |
| 6,901,987 | B1 | 6/2005 | Graham | |
| 7,407,237 | B2 * | 8/2008 | Bright | 312/242 |
| 7,481,014 | B2 * | 1/2009 | Milburn | 40/724 |
| 7,513,633 | B2 * | 4/2009 | Ermeti | 362/84 |
| 7,806,255 | B1 * | 10/2010 | Staver | 206/6.1 |
| 7,967,400 | B1 * | 6/2011 | Collum | 312/246 |
| 2007/0013278 | A1 * | 1/2007 | Herber | 312/227 |
| 2007/0013279 | A1 * | 1/2007 | MacMillan et al. | 312/242 |
| 2009/0015121 | A1 * | 1/2009 | Sampson | 312/242 |
| 2012/0146470 | A1 * | 6/2012 | Katz et al. | 312/225 |
| 2012/0223626 | A1 * | 9/2012 | Thomas | 312/242 |

* cited by examiner

*Primary Examiner* — Daniel Rohrhoff

(74) *Attorney, Agent, or Firm* — Crose Law LLC; Bradley D. Crose

(57) ABSTRACT

A hidden wall storage system is disclosed. In one embodiment, a wall depository includes: a storage receptacle assembly adapted for secure, concealed placement in an opening formed within a building wall, generally between a pair of wall studs, the receptacle defined by a rear wall, a left side wall, a right side wall, a top wall, and a bottom wall; and a frame assembly hingedly coupled to the storage receptacle assembly and adapted to pivot outwardly to expose a storage receptacle and to close inwardly to secure and conceal the storage receptacle.

9 Claims, 10 Drawing Sheets

HIDDEN WALL STORAGE SYSTEM

FIELD OF THE INVENTION

The technology described herein relates generally to the fields of concealed storage, framing systems, in-wall storage systems, wall safes, and the like. More specifically, this technology relates to a combined concealed wall storage system and framing system.

BACKGROUND OF THE INVENTION

Secret storage compartments are known to be used for storing and concealing items in a hidden manner. There are a number of wall safes, and the like, known in the background art utilized to store valuables within the wall of a building. These known devices and systems have many shortcomings and deficiencies which are overcome by technology described herein.

Related patents known in the art include the following: U.S. Pat. No. 4,083,314, issued to Garvin on Apr. 11, 1978, discloses a wall depository. U.S. Pat. No. 4,244,303, issued to Kurasik on Jan. 13, 1981, discloses a combination picture frame and repository. U.S. Pat. No. 4,821,652, issued to Hoffman on Apr. 18, 1989, discloses a wall safe simulating an air vent. U.S. Pat. No. 5,066,079, issued to Lawrence on Nov. 19, 1991, discloses a door safe apparatus. U.S. Pat. No. 5,586,934, issued to Dombrowski et al. on Dec. 24, 1996, discloses a wall safe. U.S. Pat. No. 6,901,987, issued to Graham on Jun. 7, 2005, discloses a furled decorative covering apparatus and method.

The foregoing patent and other information reflect the state of the art of which the inventor is aware and are tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides a combined concealed wall storage system and framing system In one exemplary embodiment, the technology described herein provides a wall depository. The wall depository includes: a storage receptacle assembly adapted for secure, concealed placement in an opening formed within a building wall, generally between a pair of wall studs, the receptacle defined by a rear wall, a left side wall, a right side wall, a top wall, and a bottom wall; and a frame assembly hingedly coupled to the storage receptacle assembly and adapted to pivot outwardly to expose a storage receptacle and to close inwardly to secure and conceal the storage receptacle.

In at least one embodiment, the wall depository also includes a closure device adapted to secure the frame assembly to the storage receptacle assembly in a closed position and to release the frame assembly from the storage receptacle assembly in an open position.

In at least one embodiment, the wall depository further includes at least one concealed inset hinge adapted to secure the frame assembly to the storage receptacle assembly in a closed position and to hingedly release the frame assembly from the storage receptacle assembly in an open position.

In at least one embodiment, the wall depository also includes a rim disposed on the outermost portions of the rear wall, the left side wall, the right side wall, the top wall, and the bottom wall of the storage receptacle, the rim adapted to secure the storage receptacle to the building wall such that the storage receptacle is not insertable too far into the building wall and to provide a clearance by which the frame assembly pivots outwardly without touching the wall.

In at least one embodiment, the wall depository further includes a first plurality of hooks disposed within the storage receptacle and adapted to receive one or more hanging items.

In at least one embodiment, the wall depository also includes a second plurality of hooks disposed on an external surface of the wall depository and adapted to receive one or more hanging items.

In at least one embodiment, the wall depository further includes a front wall of fractional height relative to the storage receptacle and adapted to provide a tray within the storage receptacle within which to place a multiplicity of items.

In at least one embodiment, the wall depository also includes a flashlight mount disposed within the storage receptacle and adapted to receive a flashlight.

In at least one embodiment, the wall depository further includes a mount disposed upon at least one of the left side wall and right side wall and adapted to secure the storage receptacle to a wall stud.

In at least one embodiment, the wall depository also includes a rear wall having cork board and adapted to receive pinned items.

In at least one embodiment, the wall depository further includes: a sensor; and an illumination device disposed within the storage device and adapted to provide illumination automatically when the frame assembly is opened from the storage receptacle assembly to an open position, as detected by the sensor, and to cease illumination when the frame assembly is closed toward the storage receptacle assembly, as detected by the sensor.

In at least one embodiment, the wall depository also includes a frame assembly having: a top frame member; a bottom frame member; a left side frame member; and a right side frame member. The top, bottom, left, and right side frame members form a generally rectangular frame to frame an item.

In various embodiments the frame assembly of the wall depository includes a picture, a mirror, or the like.

In another exemplary embodiment, the technology described herein provides a combined frame and storage apparatus for storing and hiding items in an opening formed within the wall of a building. The combined frame and storage apparatus includes: a storage receptacle assembly adapted for secure, concealed placement in an opening formed within a building wall, generally between a pair of wall studs, the receptacle defined by a rear wall, a left side wall, a right side wall, a top wall, and a bottom wall; a frame assembly having a top frame member, a bottom frame member, a left side frame member, and a right side frame member, wherein the top, bottom, left, and right side frame members form a generally rectangular frame to frame an item, the frame assembly hingedly coupled to the storage receptacle assembly and adapted to pivot outwardly to expose a storage receptacle and to close inwardly to secure and conceal the storage receptacle; a closure device adapted to secure the frame assembly to the storage receptacle assembly in a closed position and to release the frame assembly from the storage receptacle assembly in an open position; at least one concealed inset hinge adapted to secure the frame assembly to the storage receptacle assembly in a closed position and to hingedly release the frame assembly from the storage receptacle assembly in an open position; and a rim disposed on the outermost portions of the rear wall, the left side wall, the right side wall, the top wall, and the bottom wall of the storage receptacle, the rim adapted to secure the storage receptacle to the building wall such that the storage receptacle is not insertable too far into the building wall and to provide a clearance by which the frame assembly pivots outwardly without touching the wall.

In at least one embodiment, the combined frame and storage apparatus also includes a mount disposed upon at least one of the left side wall and right side wall and adapted to secure the storage receptacle to a wall stud.

In at least one embodiment, the combined frame and storage apparatus further includes: a first plurality of hooks disposed within the storage receptacle and adapted to receive one or more hanging items; and a second plurality of hooks disposed on an external surface of the wall depository and adapted to receive one or more hanging items.

In at least one embodiment, the combined frame and storage apparatus also includes a front wall of fractional height relative to the storage receptacle and adapted to provide a tray within the storage receptacle within which to place a multiplicity of items.

In at least one embodiment, the combined frame and storage apparatus further includes: a sensor; and an illumination device disposed within the storage device and adapted to provide illumination automatically when the frame assembly is opened from the storage receptacle assembly to an open position, as detected by the sensor, and to cease illumination when the frame assembly is closed toward the storage receptacle assembly, as detected by the sensor.

In yet another exemplary embodiment, the technology described herein provides a combined frame, storage, and illumination apparatus for storing and hiding items in an opening formed within the wall of a building. The combined frame, storage, and illumination apparatus includes: a storage receptacle assembly adapted for secure, concealed placement in an opening formed within a building wall, generally between a pair of wall studs, the receptacle defined by a rear wall, a left side wall, a right side wall, a top wall, and a bottom wall; a frame assembly having a top frame member, a bottom frame member, a left side frame member, and a right side frame member, wherein the top, bottom, left, and right side frame members form a generally rectangular frame to frame an item, the frame assembly hingedly coupled to the storage receptacle assembly and adapted to pivot outwardly to expose a storage receptacle and to close inwardly to secure and conceal the storage receptacle; a closure device adapted to secure the frame assembly to the storage receptacle assembly in a closed position and to release the frame assembly from the storage receptacle assembly in an open position; at least one concealed inset hinge adapted to secure the frame assembly to the storage receptacle assembly in a closed position and to hingedly release the frame assembly from the storage receptacle assembly in an open position; a rim disposed on the outermost portions of the rear wall, the left side wall, the right side wall, the top wall, and the bottom wall of the storage receptacle, the rim adapted to secure the storage receptacle to the building wall such that the storage receptacle is not insertable too far into the building wall and to provide a clearance by which the frame assembly pivots outwardly without touching the wall; a sensor; and an illumination device disposed within the storage device and adapted to provide illumination automatically when the frame assembly is opened from the storage receptacle assembly to an open position, as detected by the sensor, and to cease illumination when the frame assembly is closed toward the storage receptacle assembly, as detected by the sensor.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides a combined concealed wall storage system and framing system 10.

Figure 1:
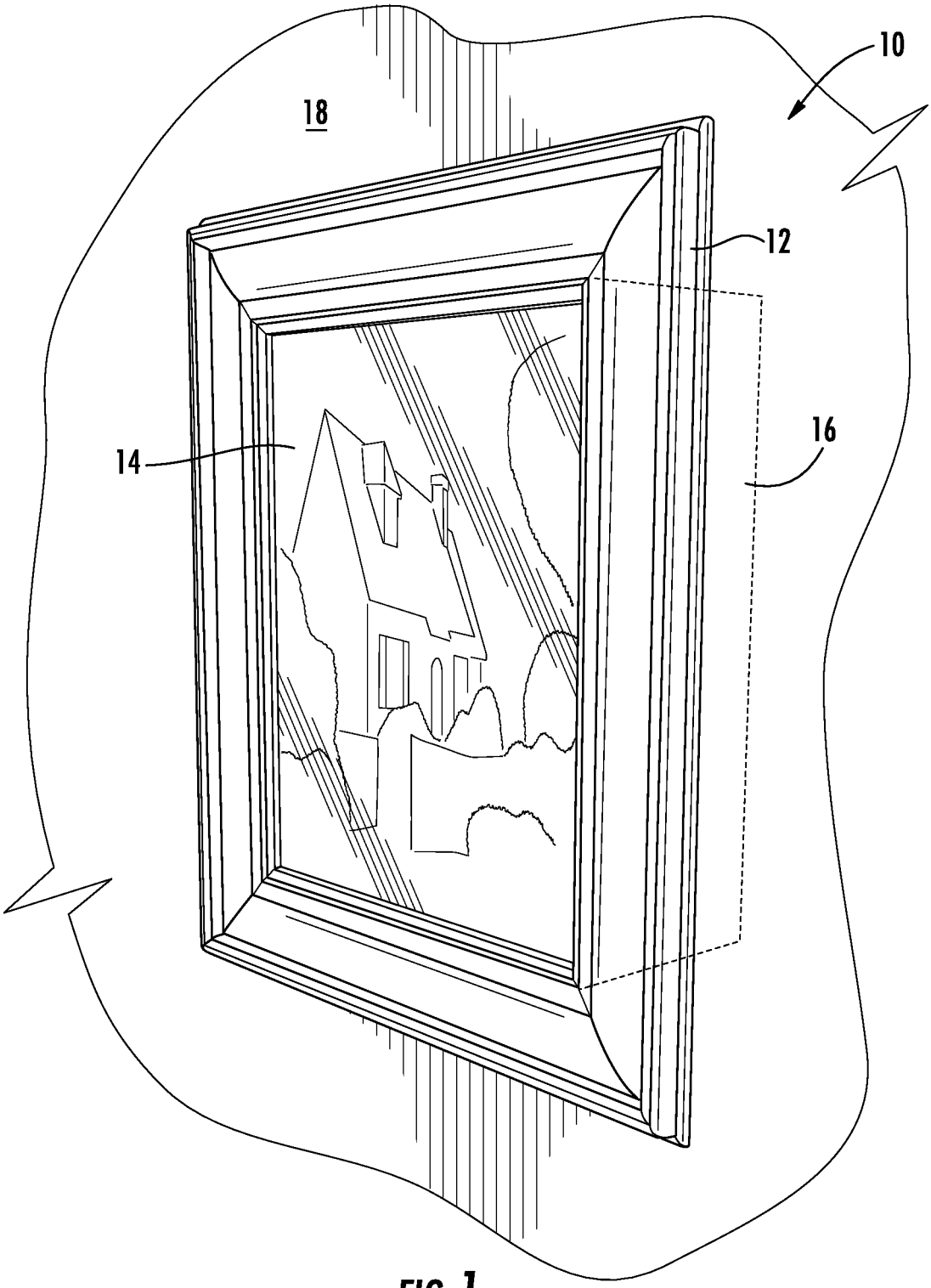
FIG. 1 is a front perspective view of a hidden wall storage system, illustrating, in particular, a hinged frame system, in a closed position, and concealed in-wall storage compartment, according to an embodiment of the invention.

Referring now to FIG. 1, a front perspective view of a hidden wall storage system 10 is depicted. The hidden wall storage system 10 includes a hinged frame system 12. The hinged frame system 12 is configured to aesthetically frame a item 14 for placement upon a wall 18. The hinged frame system 12 is shown in a closed position, concealing an in-wall storage compartment 16. As such, from all outward appearances, the apparatus appears as a typical frame to a passerby or one viewing the framed item and not a hidden storage system. No indication that anything exists behind the frame is visible from the front of the frame system 12.

As depicted the frame assembly 12 includes a top frame member, a bottom frame member, a left side frame member, and a right side frame member. The top, bottom, left, and right side frame members form a generally rectangular frame system to aesthetically frame an item. The size and shape of the frame assembly 12 can vary. The top, bottom, left, and right side frame members can be manufactured from one or more of a variety of materials such as wood, plastic, metal, and the like.

The framed item 14 may include one or more of a multiplicity of items. By way of example, framed item 14 is a picture, mirror, or the like, that is aesthetically framed within the hinged frame system 12.

In at least one embodiment, the in-wall storage compartment 16 is a wall depository having a storage receptacle assembly adapted for secure, concealed placement in an opening formed within a building wall 18, generally between a pair of wall studs. Although depicted in the figures mounted between wall studs, at least one embodiment of the technology utilizes a wall mount that does not require placement adjacent to one or more wall studs. The receptacle is defined by a rear wall, a left side wall, a right side wall, a top wall, and a bottom wall.

The in-wall storage compartment 16 can be utilized to store items, post notes, photographs, phones, chargers, wallets, pens, pencils, reminders, car keys, house keys, and the like.

In an alternative embodiment, the in-wall storage compartment 16 can be utilized to store jewelry items. As such the in-wall storage compartment 16 includes fabric or felt coverings placed upon the various rear, left side, right side, top wall, and bottom walls to protect the jewelry items and to present a finer, more aesthetically pleasing look suitable for jewelry storage. As a jewelry box, the in-wall storage compartment 16 also includes various compartments for jewelry display and storage, ring holders, hanging devices for bracelets, necklaces, and so forth.

In at least one embodiment, the hinged frame system 12 is a frame assembly hingedly coupled to the storage receptacle assembly. The hinged frame system 12 is adapted to pivot outwardly (as depicted in FIG. 2) to expose a storage receptacle 16 and to close inwardly (as depicted in FIG. 1) to secure and conceal the storage receptacle 16.

Figure 2:
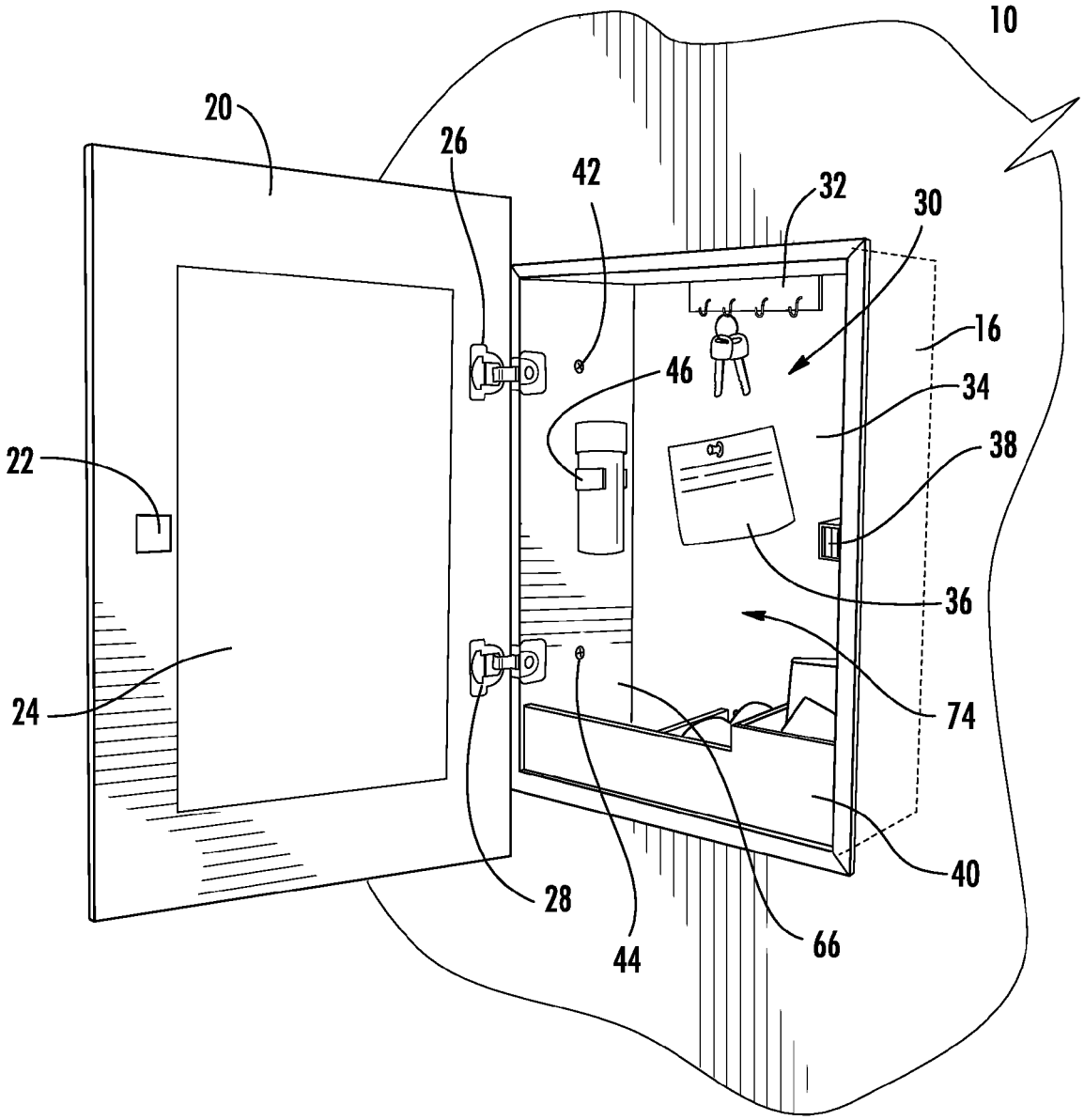
FIG. 2 is a front perspective view of the hidden wall storage system, illustrating, in particular, the hinged frame system in an open position, and accessibility to the in-wall storage compartment, according to an embodiment of the invention.

Referring now to FIG. 2, a front perspective view of the hidden wall storage system 10 is shown, illustrating, in particular, the hinged frame system 12 in an open position, and accessibility to the in-wall storage compartment 16. Multiplicities of items that can be stored and concealed within the in-wall storage compartment 16 are depicted.

Defined with the in-wall storage compartment 16 is open storage area 30. The open storage area 30 is of a generally rectangular box shape, inset into the wall 18.

Keys can be hung and stored on key ring rack 32. The key ring rack 32 provides a secure manner in which to store keys and in which the hung keys are easily visible to allow one to identify and select keys quickly. The key ring rack 32 can be used to hang items other than keys as determined and selected by the user. In an alternative embodiment, the key ring rack 32 is mounted to the top wall and not the rear wall. In yet another alternative embodiment, the rack 32 is adapted for non-key ring items such as a watch, jewelry, tethered items, or like items.

In at least one embodiment, the in-wall storage compartment 16 includes at least one clip 46. As depicted in FIG. 2, the clip 46 is defined to securely hold a flashlight or like device. In alternative embodiments, other types of clips and uses of the clips can be implemented based on user need or preference.

In at least one embodiment, the in-wall storage compartment 16 rear wall 34 is manufactured of cork board. In a preferred embodiment, the rear wall 34 is wood with a cork overlay. As such the rear wall 34 is useful to receive posted items 36, notes, photos, reminders, and the like, held in by push pins.

In at least one embodiment, the in-wall storage compartment 16 includes a front wall 40 of fractional height relative to the storage receptacle. The front wall 40 is adapted to provide a tray within the storage receptacle within which to place a multiplicity of items such as in area 74.

In at least one embodiment, the wall depository also includes a closure device adapted to secure the frame assembly 12 to the storage receptacle assembly 16 in a closed position (as depicted in FIG. 1) and to release the frame assembly 12 from the storage receptacle assembly 16 in an open position (as depicted in FIG. 2). As depicted in FIG. 2 the closure device includes a magnet 38 and a metal strip 22. However, in alternative embodiments the closure device includes paired magnets, lock and key, a spring-tensioned ball bearing, and the like.

In at least one embodiment, the wall depository further includes at least one concealed inset hinge 26, 28 adapted to secure the frame assembly 12 to the storage receptacle assembly 16 in a closed position (as depicted in FIG. 1) and to hingedly release the frame assembly from the storage receptacle assembly in an open position (as depicted in FIG. 2). In a preferred embodiment, and as depicted in FIG. 2, an upper hinge 26 and lower hinge 28 are utilized to secure the frame assembly 12 to the storage receptacle assembly 16. The upper hinge 26 and lower hinge 28 are European hinges in at least one embodiment, and as such, allow for the frame assembly 12 to open hingedly without the frame assembly 12 touching the wall 18 into which the storage receptacle assembly 16 is mounted. The size of the wall depository can vary by design, more than two hinges are utilized in larger designs as necessitated by the weight and need to secure the device to the wall.

One or more of the left and right side walls of the storage receptacle assembly 16 can include mounts. As depicted in FIG. 2, mounts 42 and 44 are provided on left side wall 66. Mounts 42 and 44 can be utilized to secure the storage receptacle assembly 16 to the wall, such as to an adjacent wall stud. The mounts 42 and 44 depicted include holes for a wood screw or the like to secure the storage receptacle assembly 16 to a wall stud on the left side. The mounts 42 and 44 can be used on one side or on both sides as required by the mounting application. In a preferable embodiment, there are at least two mounts 42, 44 on each of the left side and right side walls of the storage receptacle assembly 16. With a pair of mounts 42, 44 on each side, the storage receptacle assembly 16 is secured between two adjacent studs. Also, in alternative embodiments the size of the storage receptacle assembly 16 is varied such that it need not be limited to the width between two adjacent studs. By way of example, in a non-load bearing wall, intermediate studs can be cut such that a storage receptacle assembly 16 in greater widths is accommodated.

The hinged frame system 12 also includes an interior frame surface 20 and internal backing 24. As the frame assembly 12 is closed, the interior frame surface 20 abuts the storage receptacle assembly 16 and is close to wall such that from all outward appearances, the apparatus appears as a typical frame and not a hidden storage system. The internal backing 24 is used to provide a surface upon which a picture, mirror, the like, visible from the front side, is mounted and secured.

Figure 3:
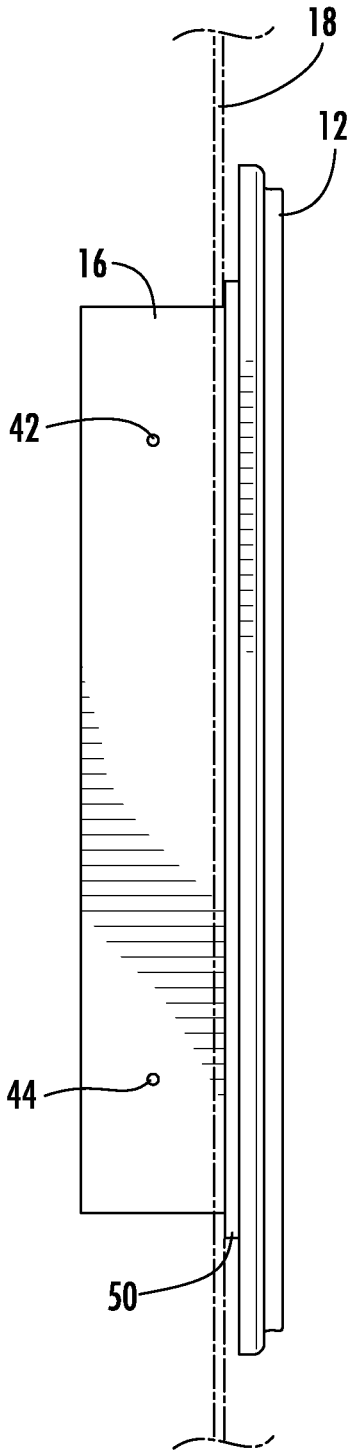
FIG. 3 is a side view of the hidden wall storage system, illustrating, in particular, the relationships of the hinged frame system to the exterior of the wall, and the in-wall storage compartment to the interior of the wall, according to an embodiment of the invention.

Referring now to FIG. 3, a side view of the hidden wall storage system 10 is shown, illustrating, in particular, the relationships of the hinged frame system 12 to the exterior of the wall 18, and the in-wall storage compartment 16 to the interior of the wall.

The in-wall storage compartment 16 includes a rim 50 that securely attached to an edge of each of the four walls forming the storage compartment. The rim 50 is disposed on the outermost portions of the rear wall, the left side wall, the right side wall, the top wall, and the bottom wall of the storage receptacle. The rim 50 is adapted to secure the storage receptacle 16 to the building wall 18 such that the storage receptacle 16 is not insertable too far into the building wall 18. The rim 50 is adapted to provide a clearance by which the frame assembly 16 pivots outwardly without touching the wall 18.

Figure 4:
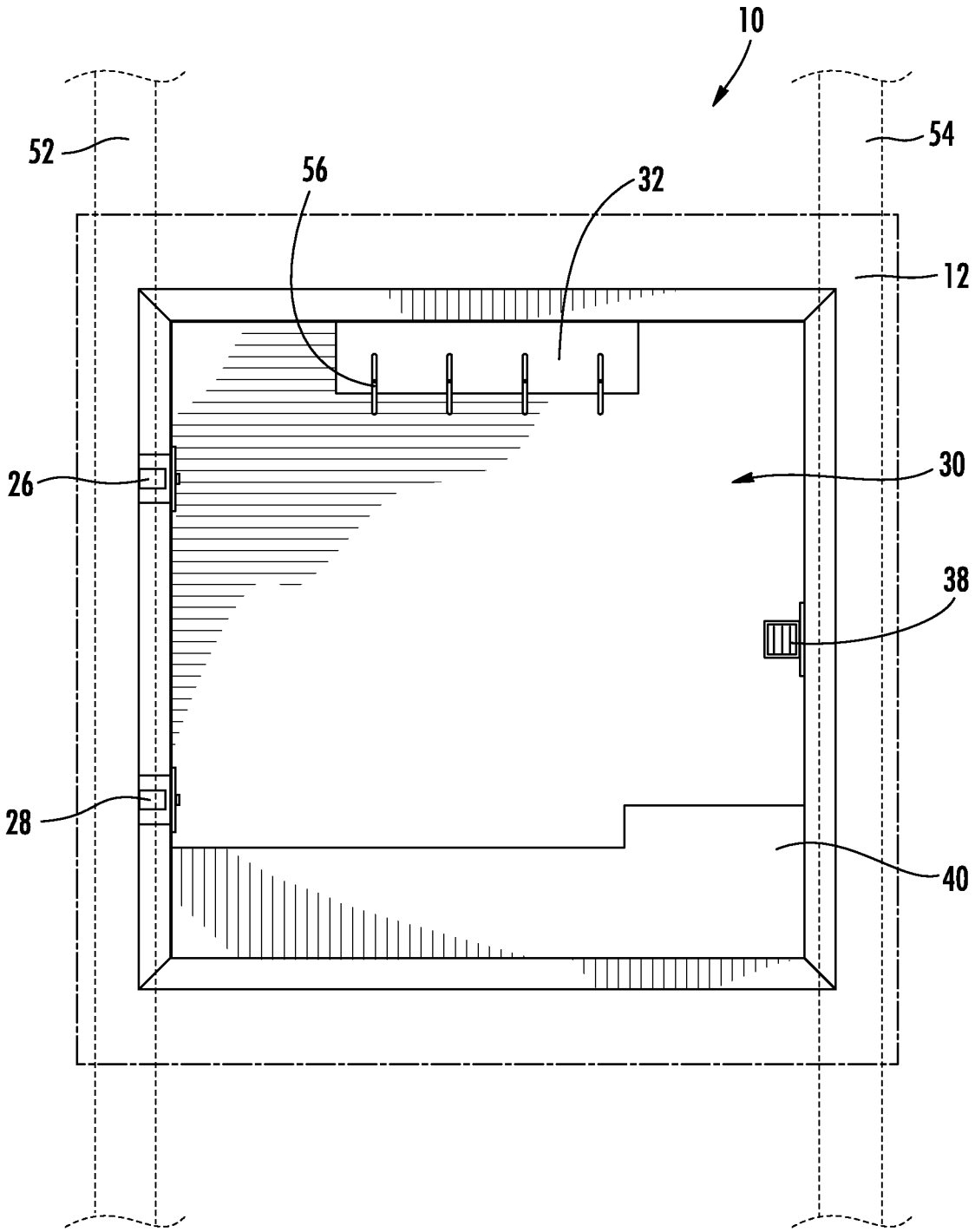
FIG. 4 is a front view of the hidden wall storage system, illustrating, in particular, the relationships of the in-wall storage compartment to the interior of the wall and to the wall studs, according to an embodiment of the invention.
Figure 5:
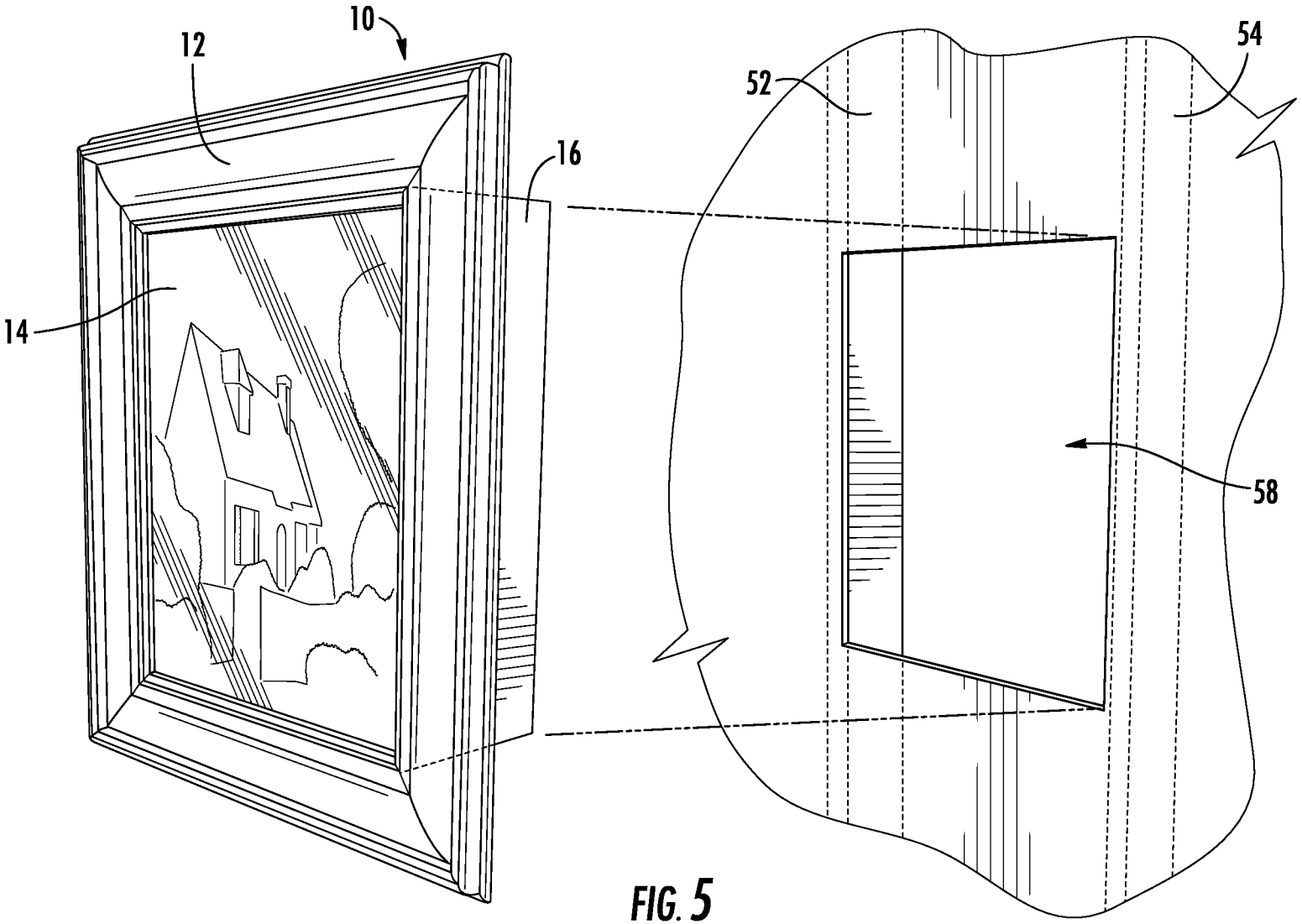
FIG. 5 is a front perspective view of a wall cavity cut and defined for receipt of the in-wall storage compartment and overlay by the hinged frame system, according to an embodiment of the invention.

Referring now to FIG. 4, a front view of the hidden wall storage system 10 is shown, illustrating, in particular, the relationships of the in-wall storage compartment 16 to the interior of the wall and to the wall studs, 52, 54. Once the appropriate cut-out has been made into the wall 18, as depicted in FIG. 5, one may insert the hidden wall storage system 10 into the wall. Upon insertion, the rim 50 is flush with the wall and secures the hidden wall storage system 10 to the wall. Mounts 42, 44, and others if needed or desired, are utilized to secure the storage receptacle 16 to the wall studs 52, 54.

Figure 8:
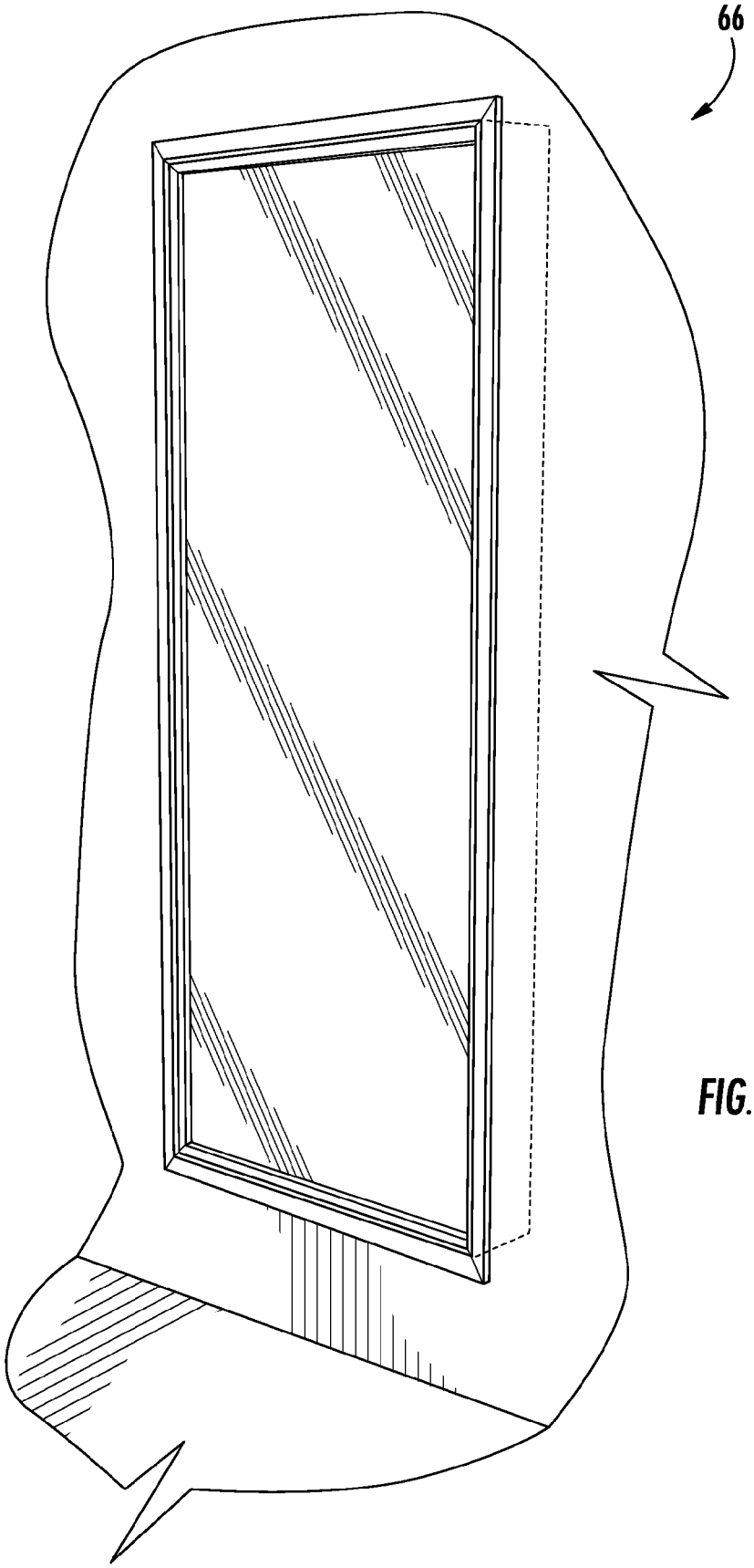
FIG. 8 is a front perspective view of a hidden wall storage system, illustrating, in particular, a hinged frame system, in a closed position, and concealed in-wall storage compartment, according to an alternative embodiment of the invention.

Referring now to FIG. 5, a front perspective view of a wall cavity 58 cut and defined for receipt of the in-wall storage compartment 16 and overlay by the hinged frame system 12. In many buildings wall studs 52, 54 are approximately sixteen inches apart. As such one may cut an approximate wall cavity 58 of fourteen and a half inches (14½"), within which the in-wall storage compartment 16 is placed. The height of the wall cavity 58 is cut to match the height of the in-wall storage compartment 16; however, the height of the in-wall storage compartment 16 can vary. By way of example, and as depicted in FIG. 8, an elongated hidden wall storage system is shown.

Figure 6:
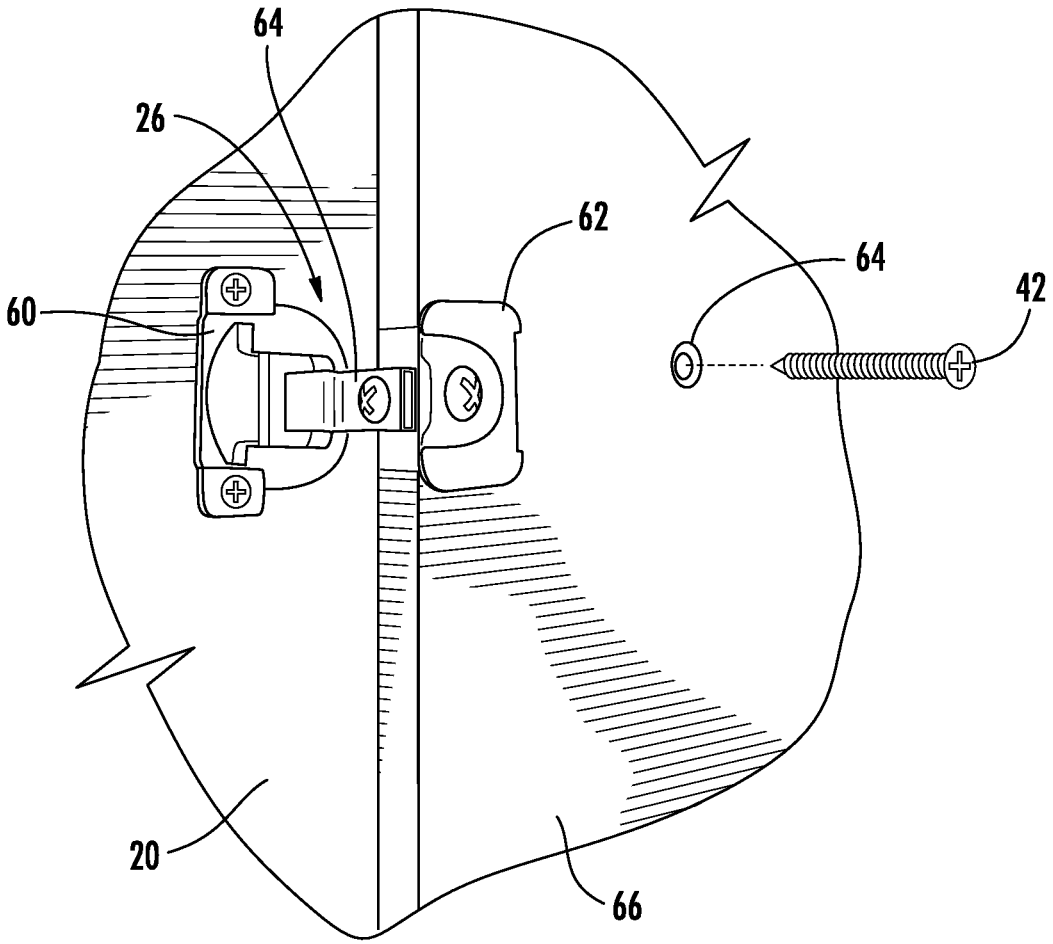
FIG. 6 is a close up perspective view of a specialized hinge to hingedly couple the hinged frame system to the in-wall storage compartment, according to an embodiment of the invention.

Referring now to FIG. 6, a close up perspective view of a specialized hinge 26 is shown. The specialized hinge 26 is configured to hingedly couple the hinged frame system 12 to the in-wall storage compartment 16. The specialized hinge 26 includes wall bracket 62, or base plate, mounted to left side wall 66 (as depicted) but can vary in placement. The specialized hinge 26 include frame bracket 60 which is shown attached to the interior frame 20. Wall bracket 62 is coupled to frame bracket 60 by arm 64.

The specialized hinge 26 is adapted to secure the frame assembly 12 to the storage receptacle assembly 16 in a closed position (as depicted in FIG. 1) and to hingedly release the frame assembly from the storage receptacle assembly in an open position (as depicted in FIG. 2). As depicted in FIG. 2, an upper hinge 26 and lower hinge 28 are utilized to secure the frame assembly 12 to the storage receptacle assembly 16.

Figure 7:
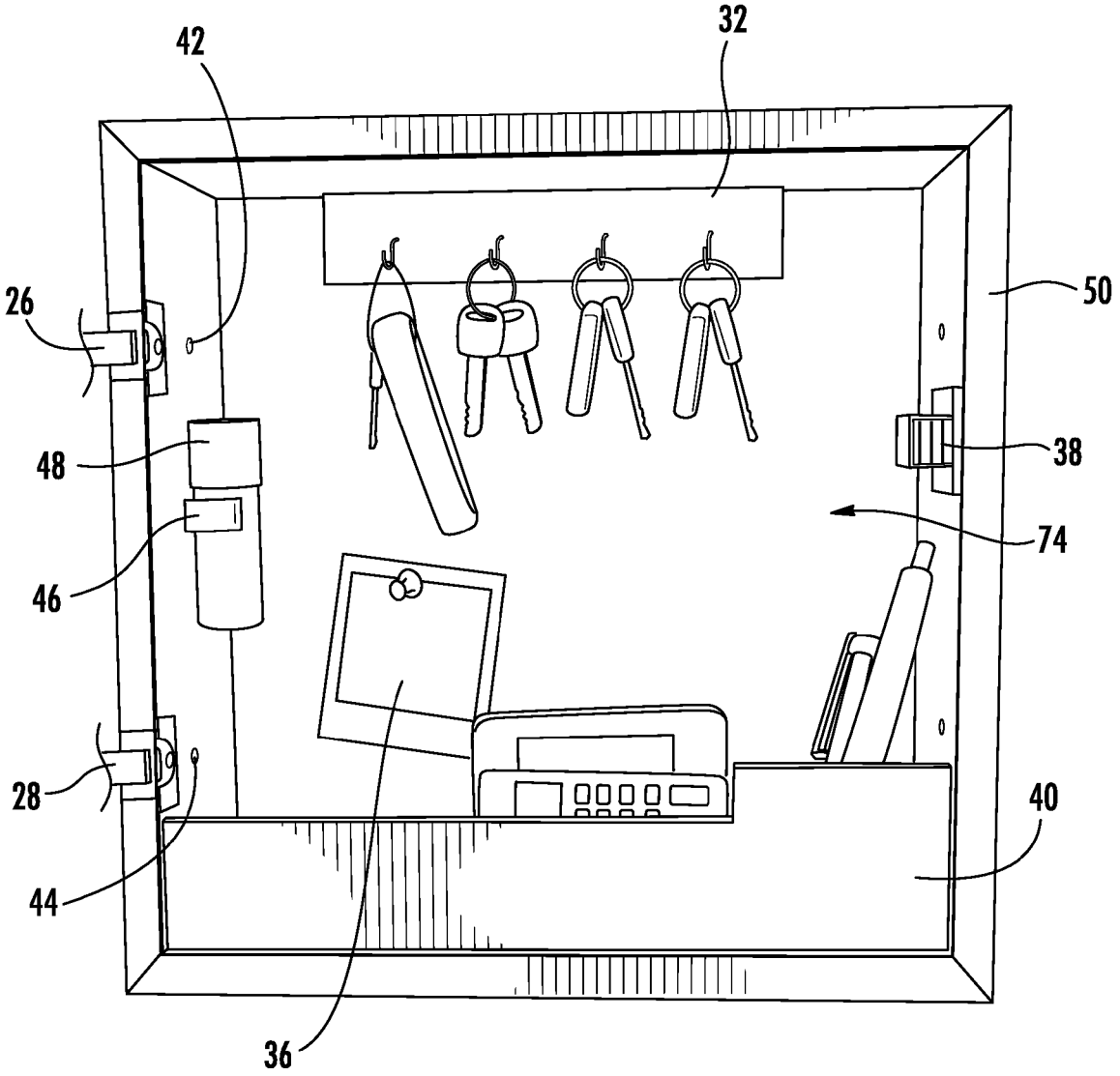
FIG. 7 is a front view of the in-wall storage compartment, illustrating, in particular, a multiplicity of stored items, hooks, rings, post-it board, mounts, and closure device, according to an embodiment of the invention.

Referring now to FIG. 7, a front view of the in-wall storage compartment 16 is shown. The in-wall storage compartment 16 can be utilized to store items, post notes, photographs, phones, chargers, wallets, pens, pencils, reminders, car keys, house keys, and the like. In an alternative embodiment, the in-wall storage compartment 16 can be utilized to store jewelry items.

Referring now to FIG. 8, a front perspective view of the hidden wall storage system 66 is shown in an alternative embodiment. The hidden wall storage system 66 is an elongated version of that shown in FIG. 1. By way of example, this embodiment may include a mirror as the framed item and open into a larger storage area for storing items.

Figure 9:
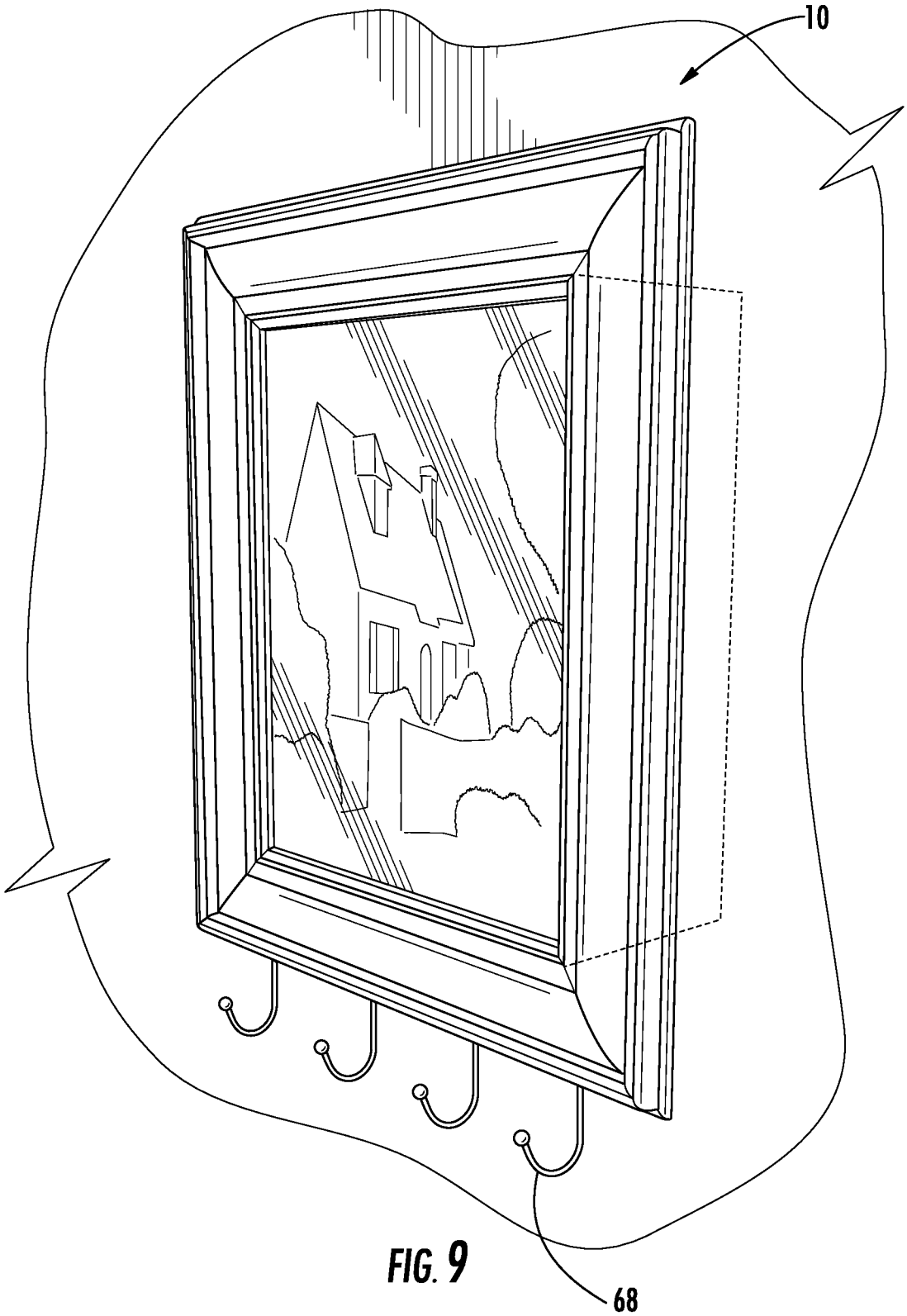
FIG. 9 is a front perspective view of a hidden wall storage system, illustrating, in particular, a hinged frame system, in a closed position and having hooks, and concealed in-wall storage compartment, according to an alternative embodiment of the invention.

Referring now to FIG. 9, a front perspective view of the hidden wall storage system 10 is shown, illustrating, in particular, a hinged frame system, in a closed position and having hooks 68, and concealed in-wall storage compartment. This multiplicity of hooks 68 is disposed on an external surface of the wall depository and adapted to receive one or more hanging items. By way of example, a coat or bag may be hung on one of the hooks 68.

Figure 10:
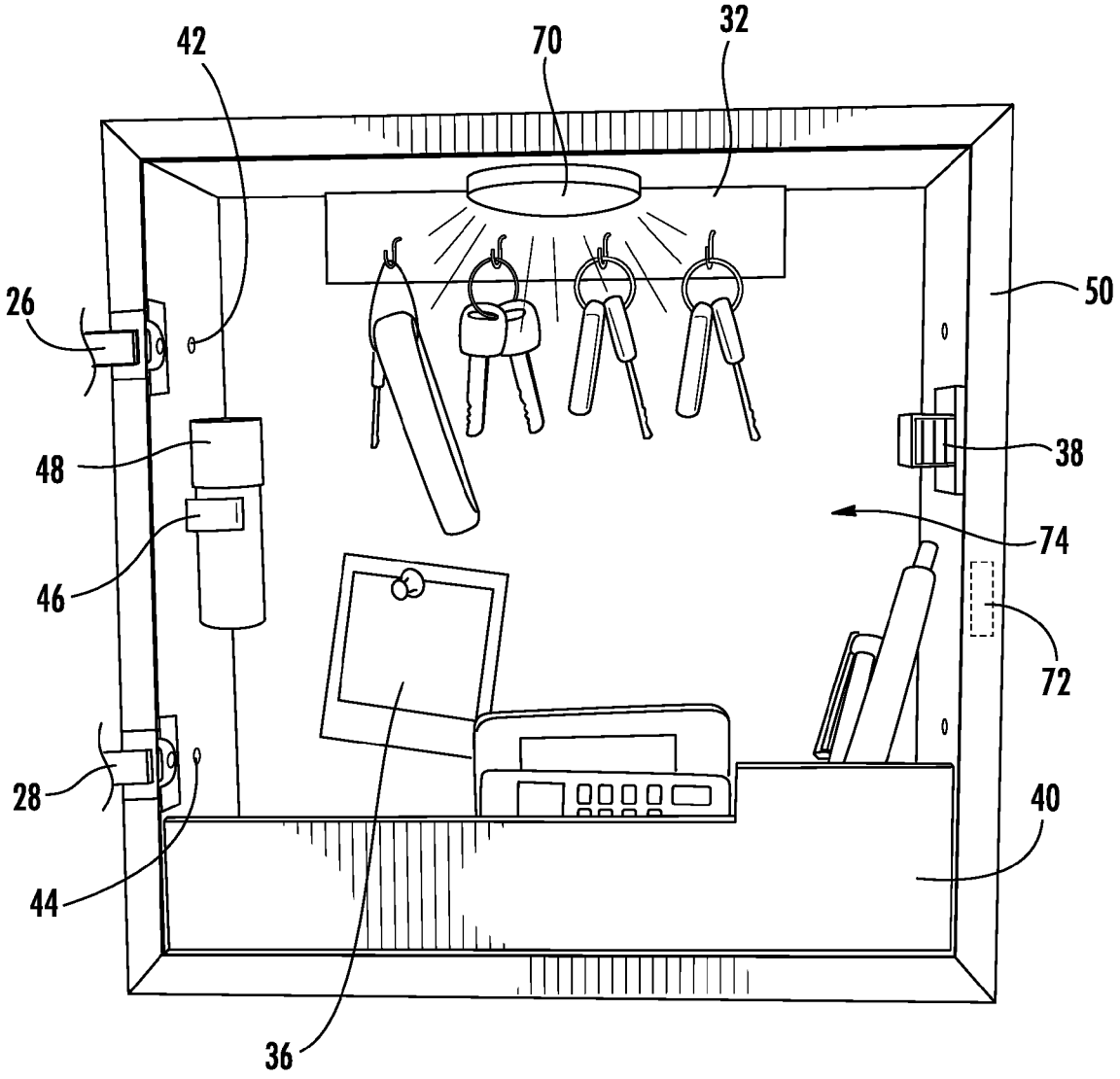
FIG. 10 is a front view of the in-wall storage compartment, illustrating, in particular, a multiplicity of stored items, hooks, rings, post-it board, mounts, a closure device, and a light and light activation means, according to an embodiment of the invention.

Referring now to FIG. 10, a front view of the in-wall storage compartment 16 is shown. In addition to the elements already depicted, and particularly those of FIG. 7, this embodiment of the in-wall storage compartment 16 includes a sensor 72 and an illumination device 70.

The illumination device can be disposed within the storage assembly 16, such as within rim 50. The illumination device 70 is adapted to provide illumination automatically when the frame assembly 12 is opened from the storage receptacle assembly 12 to an open position, as detected by the sensor 72, and to cease illumination when the frame assembly 12 is closed toward the storage receptacle assembly 12, as detected by the sensor 72.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

What is claimed is:

1. A wall depository comprising:

a storage receptacle assembly adapted for secure, concealed placement in an opening formed within a building wall, between a pair of wall studs, the receptacle defined by a rear wall, a left side wall, a right side wall, a top wall, and a bottom wall;

a picture;

a frame assembly, having a top frame member, a bottom frame member, a left side frame member, and a right side frame member, to form a generally rectangular frame to interchangeably frame the picture, and having an interior frame surface and internal backing, wherein the interior frame surface abuts the storage receptacle assembly and is close to a wall such that from all outward appearances, the apparatus appears as a typical picture frame and not a hidden storage system, and wherein the internal backing is used to provide a surface upon which the picture is mounted interchangeably and secured, the frame assembly hingedly coupled to the storage receptacle assembly and adapted to pivot outwardly to expose a storage receptacle and to close inwardly to secure and conceal the storage receptacle, the frame assembly configured to interchangeably house an alternative framed item;

a first plurality of hooks disposed within the storage receptacle and adapted to receive one or more hanging items;

a rim disposed on the outermost portions of the left side wall, the right side wall, the top wall, and the bottom wall of the storage receptacle, the rim adapted to secure the storage receptacle to the building wall such that the storage receptacle is not insertable too far into the building wall and to provide a clearance by which the frame assembly pivots outwardly without touching the wall, and wherein upon insertion, the rim is flush with the building wall to secure the wall depository to the building wall yet extends outwardly to provide the clearance;

a concealed upper inset hinge and a concealed lower insert hinge disposed within the wall depository, the hinge concealed with an interior frame surface, both inset hinges adapted to secure the frame assembly to the storage receptacle assembly in a closed position and to hingedly release the frame assembly from the storage receptacle assembly in an open position, and both hinges adapted to allow for the frame assembly to open hingedly without the frame assembly touching the wall into which the storage receptacle assembly is mounted;

a pair of mounts disposed upon the left side wall and pair of mounts disposed on the right side wall and all mounts comprising holes and wood screws thereby adapted to secure the storage receptacle between two adjacent studs;

a front wall of fractional height relative to the storage receptacle and adapted to provide a tray within the storage receptacle within which to place a multiplicity of items;

at least one clip adapted to securely hold a device placed within the clip;

a key ring rack to provide a secure manner in which to store keys and in which the hung keys are easily visible to allow one to identify and select keys quickly; and a closure device comprising a magnet and a metal strip adapted to secure the frame assembly to the storage receptacle assembly in a closed position and to release the frame assembly from the storage receptacle assembly in an open position;

wherein the rear wall is comprised of wood and further comprises a cork board overlay adapted to receive pinned items.

2. The wall depository of claim 1, wherein the storage receptacle assembly further comprises:

a second plurality of hooks disposed on an external surface of the wall depository and adapted to receive one or more hanging items.

3. The wall depository of claim 1, wherein the storage receptacle assembly further comprises:

a flashlight mount disposed within the storage receptacle and adapted to receive a flashlight.

4. The wall depository of claim 1, further comprising:

a sensor; and an illumination device disposed within the storage device and adapted to provide illumination automatically when the frame assembly is opened from the storage receptacle assembly to an open position, as detected by the sensor, and to cease illumination when the frame assembly is closed toward the storage receptacle assembly, as detected by the sensor.

5. The wall depository of claim 1, wherein the frame assembly further comprises:

a mirror.

6. A combined frame and storage apparatus for storing and hiding items in an opening formed within the wall of a building, the apparatus comprising:

a storage receptacle assembly adapted for secure, concealed placement in an opening formed within a building wall, between a pair of wall studs, the receptacle defined by a rear wall, a left side wall, a right side wall, a top wall, and a bottom wall;

a picture;

a frame assembly having a top frame member, a bottom frame member, a left side frame member, and a right side frame member, wherein the top, bottom, left, and right side frame members form a generally rectangular frame to frame an item, wherein the interior frame surface abuts the storage receptacle assembly and is close to a wall such that from all outward appearances, the apparatus appears as a typical picture frame and not a hidden storage system, and wherein the internal backing is used to provide a surface upon which the picture is mounted interchangeably and secured, the frame assembly, the frame assembly hingedly coupled to the storage receptacle assembly and adapted to pivot outwardly to expose a storage receptacle and to close inwardly to secure and conceal the storage receptacle, the frame assembly configured to interchangeably house an alternative framed item;

a first plurality of hooks disposed within the storage receptacle and adapted to receive one or more hanging items;

a closure device comprising a magnet and a metal strip adapted to secure the frame assembly to the storage receptacle assembly in a closed position and to release the frame assembly from the storage receptacle assembly in an open position;

a concealed upper inset hinge and a concealed lower insert hinge disposed within a wall depository, the hinge concealed with an interior frame surface, both inset hinges adapted to secure the frame assembly to the storage receptacle assembly in a closed position and to hingedly release the frame assembly from the storage receptacle assembly in an open position, and both hinges adapted to allow for the frame assembly to open hingedly without the frame assembly touching the wall into which the storage receptacle assembly is mounted;

a pair of mounts disposed upon the left side wall and pair of mounts disposed on the right side wall and all mounts comprising holes and wood screws thereby adapted to secure the storage receptacle between two adjacent studs;

a key ring rack to provide a secure manner in which to store keys and in which the hung keys are easily visible to allow one to identify and select keys quickly;

a rim disposed on the outermost portions of the left side wall, the right side wall, the top wall, and the bottom wall of the storage receptacle, the rim adapted to secure the storage receptacle to the building wall such that the storage receptacle is not insertable too far into the building wall and to provide a clearance by which the frame assembly pivots outwardly without touching the wall;

a front wall of fractional height relative to the storage receptacle and adapted to provide a tray within the storage receptacle within which to place a multiplicity of items; and at least one clip adapted to securely hold a device placed within the clip;

wherein the rear wall is comprised of wood and further comprises a cork board overlay adapted to receive pinned items.

7. The apparatus of claim 6, further comprising:

a second plurality of hooks disposed on an external surface of the wall depository and adapted to receive one or more hanging items.

8. The apparatus of claim 6, further comprising:

a sensor; and an illumination device disposed within the storage device and adapted to provide illumination automatically when the frame assembly is opened from the storage receptacle assembly to an open position, as detected by the sensor, and to cease illumination when the frame assembly is closed toward the storage receptacle assembly, as detected by the sensor.

9. A combined frame, storage, and illumination apparatus for storing and hiding items in an opening formed within the wall of a building, the apparatus comprising:

a storage receptacle assembly adapted for secure, concealed placement in an opening formed within a building wall, between a pair of wall studs, the receptacle defined by a rear wall, a left side wall, a right side wall, a top wall, and a bottom wall;

a picture;

a frame assembly having a top frame member, a bottom frame member, a left side frame member, and a right side frame member, wherein the top, bottom, left, and right side frame members form a generally rectangular frame to frame an item, wherein the interior frame surface abuts the storage receptacle assembly and is close to a wall such that from all outward appearances, the apparatus appears as a typical picture frame and not a hidden storage system, and wherein the internal backing is used to provide a surface upon which the picture is mounted interchangeably and secured, the frame assembly, the frame assembly hingedly coupled to the storage receptacle assembly and adapted to pivot outwardly to expose a storage receptacle and to close inwardly to secure and conceal the storage receptacle, the frame assembly configured to interchangeably house an alternative framed item;

a first plurality of hooks disposed within the storage receptacle and adapted to receive one or more hanging items;

a closure device comprising a magnet and a metal strip adapted to secure the frame assembly to the storage receptacle assembly in a closed position and to release the frame assembly from the storage receptacle assembly in an open position;

a concealed upper inset hinge and a concealed lower insert hinge disposed within the wall depository, the hinge concealed with an interior frame surface, both inset hinges adapted to secure the frame assembly to the storage receptacle assembly in a closed position and to hingedly release the frame assembly from the storage receptacle assembly in an open position, and both hinges adapted to allow for the frame assembly to open hingedly without the frame assembly touching the wall into which the storage receptacle assembly is mounted;

a pair of mounts disposed upon the left side wall and pair of mounts disposed on the right side wall and all mounts comprising holes and wood screws thereby adapted to secure the storage receptacle between two adjacent studs;

a key ring rack to provide a secure manner in which to store keys and in which the hung keys are easily visible to allow one to identify and select keys quickly; and a rim disposed on the outermost portions of the left side wall, the right side wall, the top wall, and the bottom wall of the storage receptacle, the rim adapted to secure the storage receptacle to the building wall such that the storage receptacle is not insertable too far into the building wall and to provide a clearance by which the frame assembly pivots outwardly without touching the wall;

a sensor; and an illumination device disposed within the storage device and adapted to provide illumination automatically when the frame assembly is opened from the storage receptacle assembly to an open position, as detected by the sensor, and to cease illumination when the frame assembly is closed toward the storage receptacle assembly, as detected by the sensor;

a front wall of fractional height relative to the storage receptacle and adapted to provide a tray within the storage receptacle within which to place a multiplicity of items; and at least one clip adapted to securely hold a device placed within the clip;

wherein the rear wall is comprised of wood and further comprises a cork board overlay adapted to receive pinned items.

* * * * *